US008851300B2

(12) United States Patent
Dykstra

(10) Patent No.: US 8,851,300 B2
(45) Date of Patent: Oct. 7, 2014

(54) ROLL-OUT SHELVING STORAGE RACK SYSTEM

(75) Inventor: Daniel Dykstra, San Marcos, TX (US)

(73) Assignee: Proper Storage Systems, LLC

( * ) Notice: Subject to any disclaimer, the term of this patent is extended or adjusted under 35 U.S.C. 154(b) by 607 days.

(21) Appl. No.: 13/068,259

(22) Filed: May 6, 2011

(65) Prior Publication Data

US 2012/0145663 A1 Jun. 14, 2012

Related U.S. Application Data

(60) Provisional application No. 61/459,459, filed on Dec. 13, 2010.

(51) Int. Cl.
*A47B 46/00* (2006.01)

(52) U.S. Cl.
CPC ..... *A47B 46/00* (2013.01)
USPC ..... 211/1.57; 211/187; 211/190

(58) Field of Classification Search
CPC ..... A47B 46/00
USPC ..... 211/1.51, 1.57, 134, 151, 187, 190, 211/191, 175, 207, 208; 312/319.5, 319.8, 312/265.1–265.4; 108/20, 21, 143; 296/26.09
See application file for complete search history.

(56) References Cited

U.S. PATENT DOCUMENTS 1,060,215 A * 4/1913 Stoney ..... 312/215
2,797,104 A * 6/1957 Drobney et al. ..... 280/166
3,005,672 A * 10/1961 Becker ..... 312/319.7
3,708,074 A * 1/1973 Fahey et al. ..... 211/151
4,482,066 A 11/1984 Dykstra
5,031,975 A * 7/1991 Anderson ..... 312/319.7
5,052,878 A * 10/1991 Brockhaus ..... 414/522
5,158,347 A * 10/1992 Warren et al. ..... 312/319.8
5,211,296 A * 5/1993 D'Heygere ..... 211/187
5,392,951 A * 2/1995 Gardner et al. ..... 312/319.5
5,419,444 A 5/1995 Strom
5,564,767 A * 10/1996 Strepek ..... 296/26.09
5,641,082 A 6/1997 Grainger
6,068,141 A * 5/2000 Mulholland ..... 211/151
6,273,534 B1 * 8/2001 Bueley et al. ..... 312/334.8
6,431,668 B1 * 8/2002 Reddicliffe ..... 312/334.5
6,976,598 B2 * 12/2005 Engel ..... 211/187
7,140,502 B2 11/2006 Grainger
7,602,135 B2 * 10/2009 Huber et al. ..... 318/651
7,812,561 B2 * 10/2010 Hagen et al. ..... 318/568.13
7,901,017 B1 * 3/2011 Kafferlin ..... 312/221
8,157,108 B1 * 4/2012 Waldrop ..... 211/1.57
8,336,722 B2 * 12/2012 Cardwell et al. ..... 211/191

(Continued)

*Primary Examiner* — Jonathan Liu
*Assistant Examiner* — Stanton L Krycinski
(74) *Attorney, Agent, or Firm* — Christopher L. Makay

(57) ABSTRACT

A roll-out shelving storage rack system includes a frame coupled with a shelf member. The shelf member includes a base support, a shelf support tray, a shelf, and a driver. The base support mounts to the frame, and the shelf support tray engages the base support and is movable between a retracted position and an extended position. The shelf engages the shelf support tray and is movable between a retracted position and an extended position. The driver is coupled to the base support and the shelf. Activation of the driver moves the shelf from its retracted position to its extended position. Further, when the shelf reaches its fully extended position, the shelf support tray moves from its retracted position to its extended position. The extension of the shelf support tray substantially and completely extends the shelf outside of the frame.

13 Claims, 11 Drawing Sheets

(56) References Cited

U.S. PATENT DOCUMENTS

| | | | | |
|---|---|---|---|---|
| 2002/0110447 | A1 | 8/2002 | Stone | |
| 2003/0095859 | A1 | 5/2003 | Morman | |
| 2003/0107305 | A1* | 6/2003 | Kusztal et al. | 312/223.3 |
| 2003/0189021 | A1* | 10/2003 | Engel | 211/187 |
| 2005/0006331 | A1* | 1/2005 | Engel | 211/151 |
| 2006/0032830 | A1* | 2/2006 | Engel | 211/187 |
| 2006/0273703 | A1 | 12/2006 | Hardt, II | |
| 2007/0003399 | A1 | 1/2007 | Laursen | |
| 2009/0102338 | A1* | 4/2009 | Wenzel et al. | 312/319.1 |
| 2009/0134754 | A1* | 5/2009 | Wenzel et al. | 312/319.8 |
| 2012/0248046 | A1* | 10/2012 | Warner | 211/1.57 |

* cited by examiner

ROLL-OUT SHELVING STORAGE RACK SYSTEM

CROSS-REFERENCE TO RELATED APPLICATION

This present application claims all available benefit, under 35 U.S.C. §119(e), of U.S. provisional patent application Ser. No. 61/459,459 filed Dec. 13, 2010. By this reference, the full disclosure of U.S. provisional patent application Ser. No. 61/459,459 is incorporated herein as though now set forth in its entirety.

BACKGROUND OF THE INVENTION

1. Field of the Invention

The present invention relates to a roll-out shelving storage rack system. More particularly, the roll-out shelving storage rack system includes adjustable shelves that also substantially, completely extend and retract.

2. Description of the Related Art

In most modern businesses, space is at a premium. As such, businesses strive to maximize storage which reduces costs as well as allows for more profit per a given amount of space. A solution often employed by businesses involves the use of storage racks designed to increase the amount of storage at any given space. Storage racks that maximize space typically must satisfy three requirements; accessibility, adjustability, and robustness.

Storage racks have incorporated a storage shelf that has the ability to extend and retract to meet the accessibility requirement. The ability of the shelf to extend and retract allows an end user to visually examine what products or inventory are on a given shelf. In addition, this ability also allows accessibility to the end user allowing them to place and retrieve products or inventory more easily. The ability of the shelf to extend and retract is also useful to businesses that want to use an overhead crane to retrieve inventory rather than a forklift. If an overhead crane is used then the storage rack must have a shelf or shelves that extend and retract in order to retrieve inventory. However, one problem that has been encountered is that high capacity powered shelves in modern storage racks do not fully extend. In most applications a shelf cannot fully extend because some of the shelf must remain in the storage rack or else the shelf would fall out or would not be able to support adequate weight. The ability of a shelf to fully extend within a storage rack would be useful.

The ability of a storage rack shelf to extend or retract has traditionally been accomplished in one of two ways, using human power or pneumatic/hydraulics. The more weight that an extendable storage shelf can handle, the more beneficial it is to the end user. However, when the weight capacity of the storage rack is increased, this can cause problems. The more weight that is added to a shelf means more foot pounds to extend and retract a storage shelf. This can only be done up to a certain amount of weight until it is too dangerous for a human operator to manually extend or retract a storage shelf. Once this threshold has been reached, it becomes necessary to use hydraulics or pneumatics to extend and retract a shelf. Currently the highest capacity of any roll-out shelving manual rack system shelf on the market is 3000 pounds, and requires 25 pounds of force per 1000 pounds of load to extend the shelf from the rack. As stated above, pneumatics or hydraulics must be used when higher capacity extendable shelves are required. However, in the past, the use of hydraulics or pneumatics has comprised a rack system's accessibility and adjustability.

Another important feature that modern businesses require is adjustability. With different product lines and product mixes the ability to adjust the storage space to meet current needs is very useful. There are manually operated storage rack shelves that are adjustable, but currently there are no pneumatically powered storage racks with adjustable shelves.

In addition to the features mentioned above, storage racks must be robust. Many modern businesses operate heavy equipment, such as forklifts, and a storage rack needs to be robust enough to withstand an impact from such equipment to prevent an accident.

Accordingly, a storage rack system that is pneumatically powered, allows the shelves to be adjusted, allows the shelves to fully extend and retract, and maximizes the amount of space and weight a shelf can carry, while still being robust would be useful.

SUMMARY OF THE INVENTION

In accordance with the present invention, a roll-out shelving storage rack system includes a frame coupled with a first shelf member, a second shelf member, and a drive system. The frame of the storage rack system includes a top member that is reinforced and has a greater carrying capacity than the shelf member. The frame also includes vertical adjustment pillars that permit vertical adjustment of the shelf member within the frame.

The first shelf member of the roll-out shelving storage rack includes a base support, a shelf support tray, a shelf, and a driver. The base support mounts to the frame, and the shelf support tray engages the base support and is movable between a retracted position and an extended position. The shelf engages the shelf support tray and is movable between a retracted position and an extended position. The driver is coupled to the base support and the shelf. Activation of the driver moves the shelf from its retracted position to its extended position. Further, when the shelf reaches its fully extended position, the shelf support tray moves from its retracted position to its extended position. The extension of the shelf support tray substantially and completely extends the shelf outside of the frame.

The roll-out shelving storage rack may also include a second shelf member mounted to the frame. The second shelf member includes all the parts of the first shelf member including a driver. The actuation of the second shelf member's driver moves the second shelf member from its retracted position to its extended position.

The base support includes a first shelf support rail securable to the frame, a second shelf support rail securable to the frame, and a rear driver support plate secured with the first and second shelf support rails. The base support also includes first and second bearings connected to the first shelf support rail and third and fourth bearings connected to the second shelf support rail. The first and second shelf support rails of the base support each removably engage the vertical adjustment pillars of the frame to permit vertical adjustment of the shelf member within the frame.

The shelf support tray includes a back plate, first and second guiderails connected to the back plate, and a plurality of support beams connected to the first and second guiderails and to the back plate to provide support for the shelf support tray. The first and second guiderails of the shelf support tray define a frame side channel and a shelf side channel. The frame side channel of the first guiderail engages the first and second bearings of the first base support, and the frame side channel of the second guiderail engages the third and fourth bearings of the second base support, thereby coupling the shelf support tray with the base support such that the shelf support tray is movable within the base support between its retracted and extended positions.

The shelf includes a support grid, a front support bar, a rear support bar, a first and second guide rail, a rear support bar, a surface plate, and bearings. The front and rear support bars connect to the support grid. The first and second guide rails are placed at the ends of the front and rear support bars, and connect to the front support bar, the rear support bar, and the support grid. The surface plate is connected to the front support bar, the rear support bar, the support grid, and the first and second guide rails. First and second bearings are then connected to the first guide rail, and third and fourth bearings are connected to the second guide rail. The driver attaches to the front driver support plate of the shelf and the rear driver support plate of the base support, thereby allowing the shelf member to be vertically adjustable within in the frame.

The first and second bearings of the shelf engage the shelf side channel of the first guide rail of the shelf support tray, and the third and fourth bearings of the shelf engage the shelf side channel of the second guide rail of the shelf support tray such that the shelf is movable within the base support between its retracted and extended positions. The first and second guiderails of the shelf support tray include stops that halt progress of the shelf within the shelf support tray and the shelf support tray within the base support.

The roll-out shelving storage rack includes a drive system that is coupled with the first shelf member and the second shelf member for moving the first shelf member and the second shelf member between extended and retracted positions. The drive system disables the second shelf member during extension and retraction of the first shelf member. Similarly, the drive system disables the first shelf member during extension and retraction of the second shelf member.

The drive system of the roll-out shelving storage rack contains a manifold coupled with a source of pressurized air for distributing pressurized air throughout the drive system. The drive system of the roll-out shelving storage rack further includes a first start system coupled with the first shelf member and a second start system coupled with the second shelf member. The drive system of the roll-out shelving storage rack still further includes a first air valve switch, a second air valve switch, a first air valve, a second air valve, a first limit switch, and a second limit switch.

The first start system for the first shelf member includes an "out" push button valve and an "in" push button valve. The first air valve switch is coupled with the first start system, wherein activation of the "out" push button valve of the first start system actuates the first air valve switch such that the first air valve switch operates the driver of the first shelf member to extend the first shelf member. Further, the activation of the "in" push button of the first start system actuates the first air valve switch such that the first air valve switch operates the driver of the first shelf member to retract the first shelf member.

The second start system for the second shelf member includes an "out" push button valve and an "in" push button valve. The second air valve switch is coupled with the second start system, wherein activation of the "out" push button valve of the second start system actuates the second air valve switch such that the second air valve switch operates the driver of the second shelf member to extend the second shelf member. Further, the activation of the "in" push button of the second start system actuates the second air valve switch such that the second air valve switch operates the driver of the second shelf member to retract the second shelf member.

The first limit switch engages the first shelf member such that the first limit switch closes when the first shelf member resides in its retracted position. The first limit switch opens when the first shelf member moves from its retracted position. Upon the opening of the first limit switch, a first air valve coupled with the first limit switch prevents activation of the "out" and "in" push button valves of the second start system.

The second limit switch engages the second shelf member such that the second limit switch closes when the second shelf member resides in its retracted position. The second limit switch opens when the second shelf member moves from its retracted position. Upon opening of the first limit switch, a second air valve coupled with the second limit switch prevents activation of the "out" and "in" push button valves of the first start system.

It is therefore an object of the present invention to provide a roll-out shelving storage rack that includes a shelf member with a shelf that substantially and completely extends outside a frame of the roll-out shelving storage rack.

It is a further object of the present invention to provide a roll-out shelving storage rack that includes a shelf member vertically adjustable within a frame of the roll-out shelving storage rack.

It is another object of the present invention to provide a roll-out shelving storage rack that includes a drive system with a safety interlock feature that prevents simultaneous operation of the first and second shelf members of the roll-out shelving storage rack.

Still other objects, features, and advantages of the present invention will become evident to those skilled in the art in light of the following.

DETAILED DESCRIPTION OF THE PREFERRED EMBODIMENT

As required, detailed embodiments of the present invention are disclosed herein; however, it is to be understood that the disclosed embodiments are merely exemplary of the invention, which may be embodied in various forms. Figures are not necessarily to scale, and some features may be exaggerated to show details of particular components or steps.

The Figures illustrate the components comprising the roll-out shelving storage rack system 5 according to the preferred embodiment of the present invention. The components include a frame 10, shelf members 15 and 16, and a drive system 25.

Figure 1:
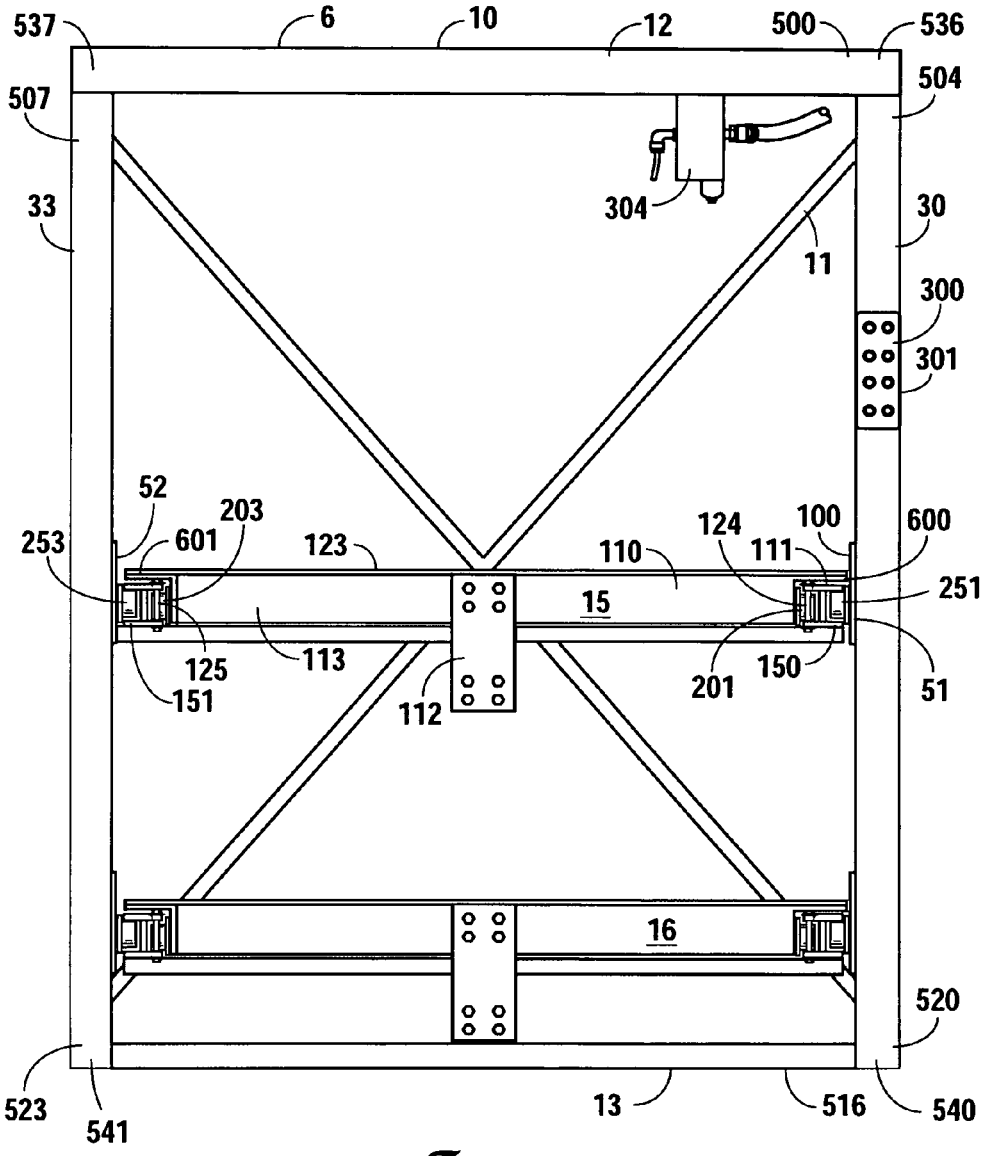
FIG. 1 is a front view illustrating a roll-out shelving storage rack system according to the preferred embodiment.
Figure 2:
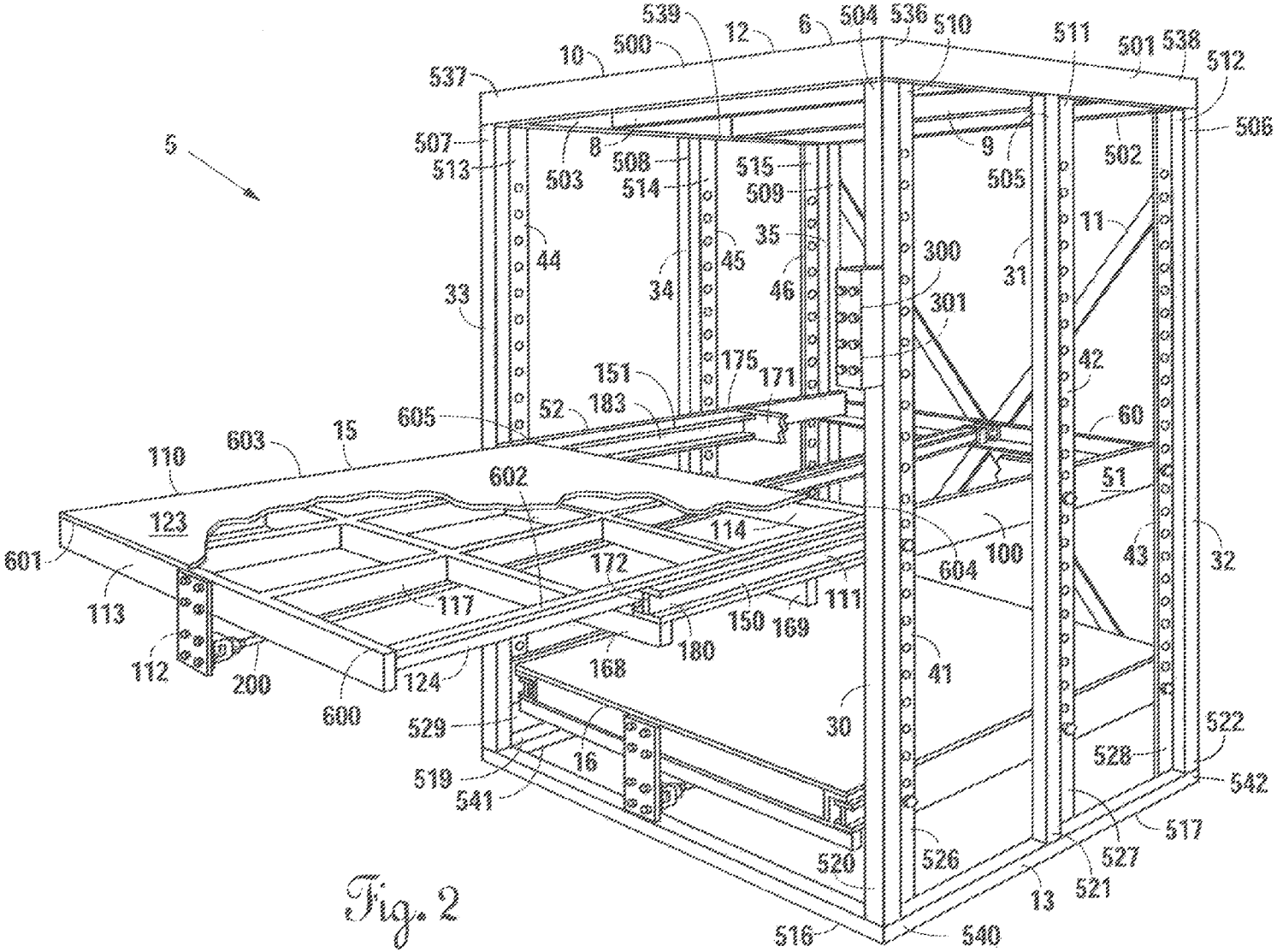
FIG. 2 is a perspective view illustrating the roll-out shelving storage rack system.
Figure 3:
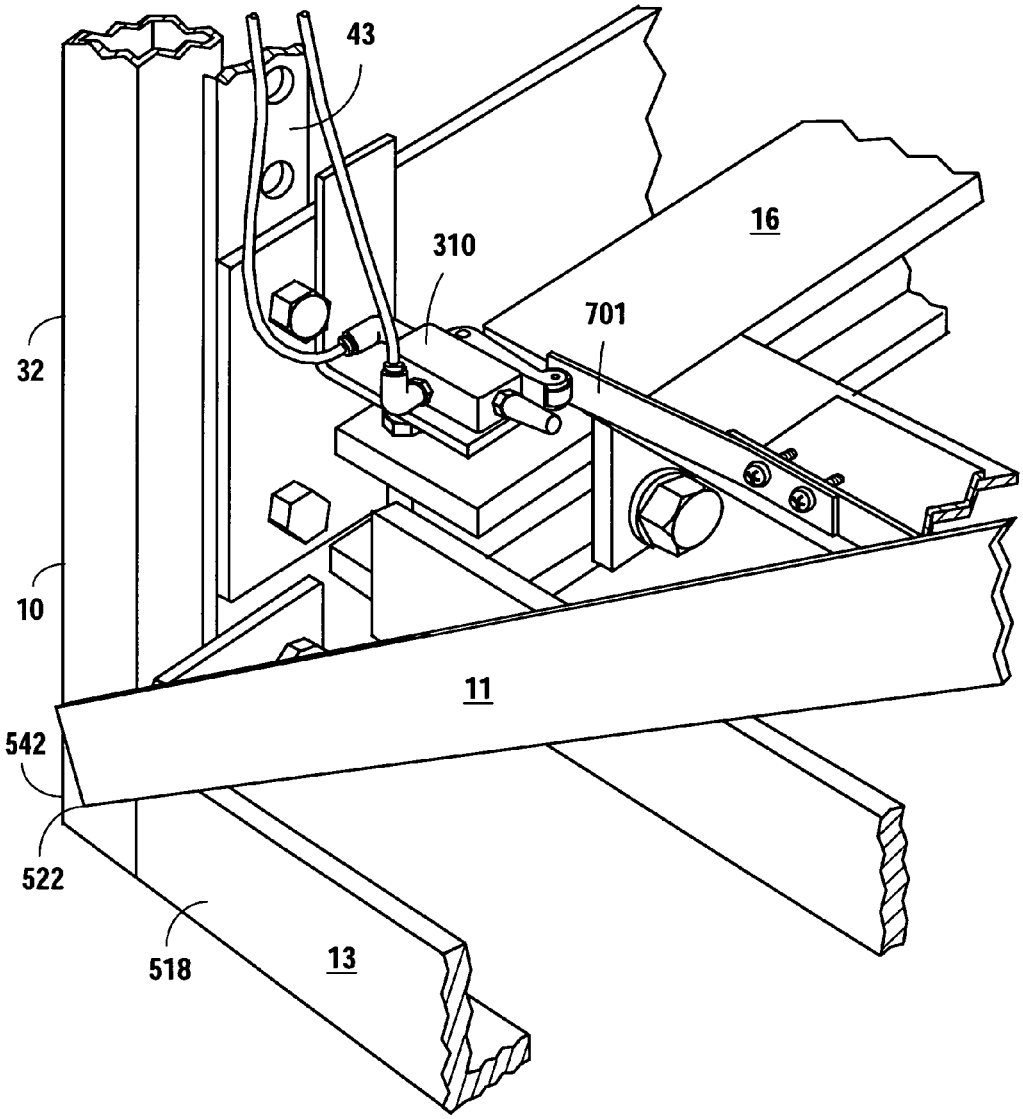
FIG. 3 is a perspective view illustrating a limit switch and a contact point of the roll-out shelving storage rack system.

FIGS. 1 and 2 illustrate the components that comprise the frame 10. The frame 10 includes a top member 12, a bottom member 13, vertical supports 30-35, vertical adjustment pillars 41-46, and a brace 11. In the preferred embodiment of the invention, the components that make up the frame 10 are made of structural steel tubing secured using any suitable means such as welding.

The top member 12 of the frame 10 has four sides 500-503, reinforcement beams 8 and 9, and a top plate 6. The top member 12 is constructed by placing the sides 500 and 502 parallel to each other and sides 501 and 503 parallel to each other. The sides 500-503 are placed at the desired distance to create the desired size of top member 12. The sides 500-503 are attached by any suitable means such as welding. The reinforcement beams 8 and 9 are attached to the sides 501 and 503 of the top member 12 by any suitable means such as welding. The top plate 6 is placed over the four sides 500-503 and reinforcement beams 8 and 9 and secured by any suitable means such as welding. After assembly the top member 12 has a right front corner 536, a left front corner 537, a right back corner 538 and a left back corner 539. The reinforcement beams 8 and 9 may provide top member 12 with a greater carrying capacity than the shelf members 15 and 16. This allows the top member 12 to be a heavy-duty storage area for the storage rack 5. In the preferred embodiment of the invention, the top member 12 can carry twice the capacity of shelf member 15 and 16.

The bottom member 13 of the frame 16 has four sides 516-519. The bottom member 13 is constructed by placing the sides 516 and 518 parallel to each other and sides 517 and 519 parallel to each other. The sides 516-519 are placed at the desired distance to create the desired size of bottom member 13. The sides 516-519 are attached by any suitable means such as welding. After assembly the bottom member 13 will have a right front corner 540, a left front corner 541, a right back corner 542 and a left back corner 543. The size of top member 12 and the bottom member 13 can be changed depending on application. Increasing or decreasing the size of the top member 12 and the bottom member 13 allows larger or smaller shelf members to be used.

The vertical supports 30-35 have top ends 504-509 and bottom ends 520-525. The vertical supports 30-35 determine the height of the storage rack system 5. Depending on application, the vertical supports 30-35 can be increased or decreased, thereby increasing or decreasing the height of the storage rack system 5. The vertical supports 30-35 also provide attachment points for the vertical adjustment pillars 41-46. The vertical adjustment pillars 41-46 have top ends 510-515 and bottom ends 526-531. The vertical adjustment pillars 41-46 are attached to the vertical supports 30-35 by any suitable means such as welding. The vertical adjustment pillars 41-46 have holes that are drilled at predetermined increments from the top ends 510-515 to the bottom ends 526-531. In the preferred embodiment of the invention, the holes are drilled at 2-inch increments.

The frame 10 is assembled in the following manner. The bottom end 520 of the vertical support 30 and the bottom end 526 of the vertical adjustment pillar 41 are attached to the right front corner 540 of the bottom member 13 by any suitable means such as welding. The bottom end 522 of the vertical support 32 and the bottom end 528 of the vertical adjustment pillar 43 are attached to the right back corner 542 of the bottom member 13 by any suitable means such as welding. The bottom end 523 of the vertical support 33 and the bottom end 529 of the vertical adjustment pillar 44 are attached to the left front corner 541 of the bottom member 13 by any suitable means such as welding. The bottom end 525 of the vertical support 35 and the bottom end 531 of the vertical adjustment pillar 46 are attached to the left back corner 543 of the bottom member 13 by any suitable means such as welding. The bottom end 521 of the vertical support 31 and the bottom end 527 of the vertical adjustment pillar are attached at the midpoint of side 517 by any suitable means such as welding. The bottom end 523 of the vertical support 34 and the bottom end 529 of the vertical adjustment pillar 45 are attached at the midpoint of the side 519 by any suitable means such as welding.

The top end 504 of the vertical support 30 and the top end 510 of the vertical adjustment pillar 41 are attached to the right front corner 536 of the top member 12 by any suitable means such as welding. The top end 506 of the vertical support 32 and the top end 512 of the vertical adjustment pillar 43 are attached to the right back corner 538 of the top member 12 by any suitable means such as welding. The top end 507 of the vertical support 33 and the top end 513 of the vertical adjustment pillar 44 are attached to the left front corner 537 of the top member 12 by any suitable means such as welding. The top end 509 of the vertical support 35 and the top end 515 of the vertical adjustment pillar 46 are attached to the left back corner 539 of the top member 12 by any suitable means such as welding. The top end 505 of the vertical support 31 and the top end 511 of the vertical adjustment pillar 42 are attached at the midpoint of side 501 by any suitable means such as welding. The top end 508 of the vertical support 34 and the top end 514 of the vertical adjustment pillar 45 are attached at the midpoint of the side 503 by any suitable means such as welding. The brace 11 is placed between vertical supports 32 and 35 and attached by any suitable means such as welding.

In FIGS. 1, 2, 8, 9, 10, and 11, there are shown shelf members 15 and 16. In the preferred embodiment of the invention, the shelf member 15 and 16 are identical. Consequently, only shelf member 15 will be described, and it should be understood by those of ordinary skill in the art that the components described in reference to the shelf member 15 are contained in the shelf member 16. Further, while the preferred embodiment of the invention discloses two shelf members 15 and 16, those of ordinary skill in the art will recognize that that a storage rack system 5 may include only one shelf member or multiple shelf members.

The shelf member 15 is comprised of a shelf 110, a shelf support tray 111, a base support 100, and a driver 200. In the preferred embodiment of the invention, the driver 200 is a pneumatic cylinder, although those of ordinary skill in the art will recognize other drivers such as a hydraulic driver, an electric motor, a chain drive, a belt and pulley, rack and pinion, or the like. The shelf 110 in the preferred embodiment of the invention is comprised of a front support bar 113, a rear support bar 114, a support grid 117, a surface plate 123, guide rails 124-125, a front driver support plate 112, and bearings 201-204. In the preferred embodiment of the invention, the front support bar 113, the rear support bar 114, the support grid 117, the surface plate 123, the guide rails 124-125, and the front driver support plate 112 are all constructed using steel.

The shelf 110 is constructed by placing the front support bar 113 and the rear support bar 114 parallel to each other and at a desired distance to create the desired size of the shelf 110.

The support grid 117 is positioned between and the front support bar 113 and the rear support bar 114 and attached by any suitable means such as welding. The guide rails 124-125 are then placed at the ends of front support bar 113, the rear support bar 114, and the support grid 117, and attached by any suitable means such as welding. The surface plate 123 is placed over the front support bar 113, the rear support bar 114, the support grid 117, the guide rails 124-125, and attached by any suitable means such as welding. The front driver support plate 112 is attached to the front support bar 113 by any suitable means such as welding. The driver 200 is attached to the front driver support plate 112 by any suitable means such as nuts and bolts. After assembly the shelf 110 will have a right front corner 600, left front corner 601, midpoints 602 and 603, a right back corner 604, and a left back corner 605.

Figure 10:
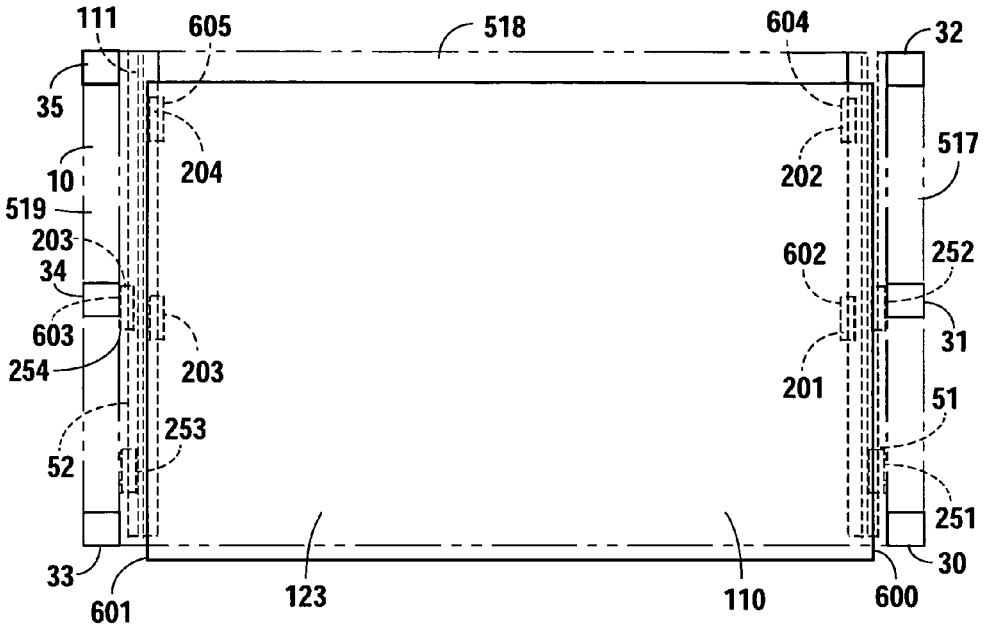
FIG. 10 is a top view illustrating the roll-out shelving storage rack system with a shelf member retracted.
Figure 11:
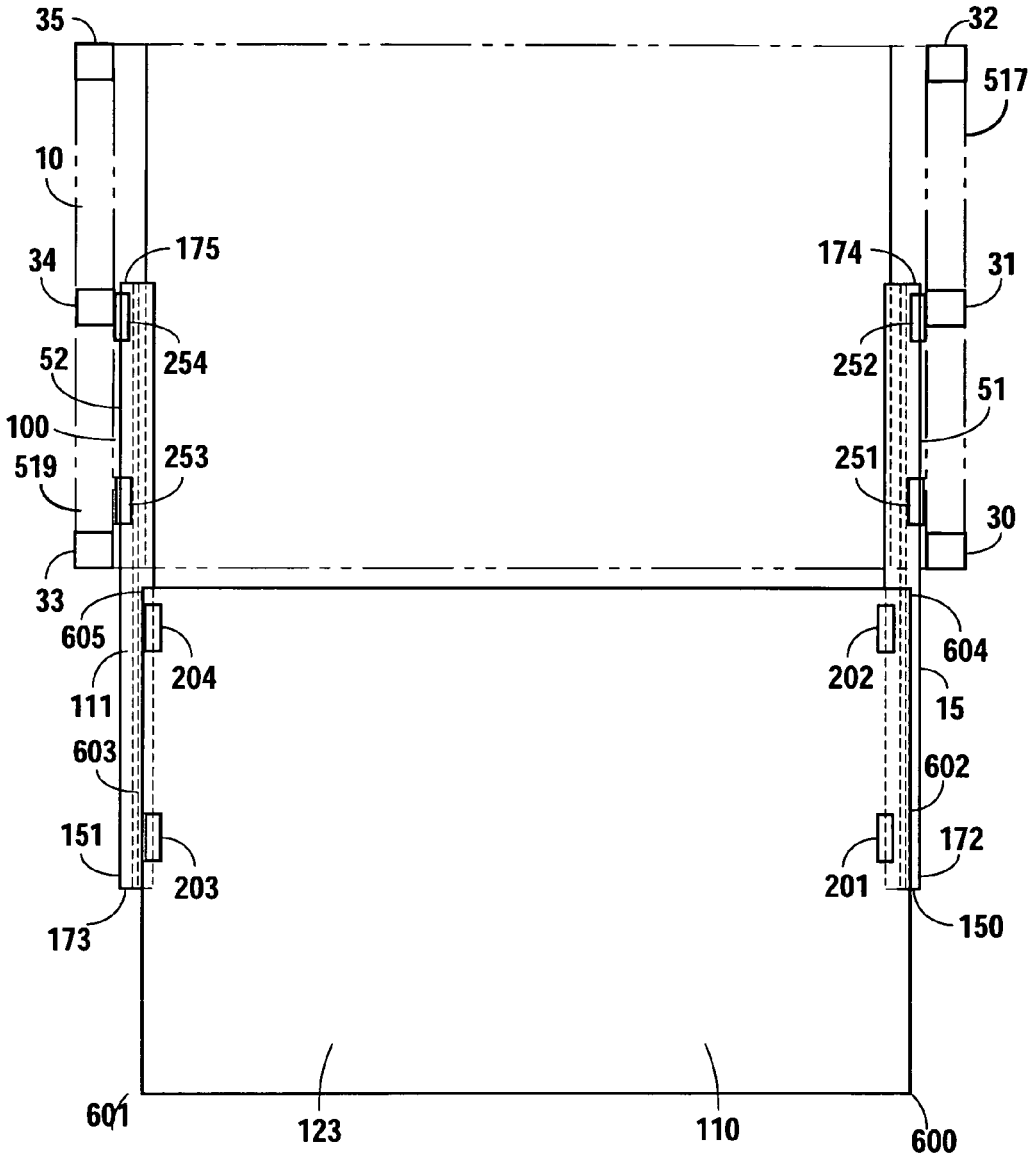
FIG. 11 is a top view illustrating the roll-out shelving storage rack system with a shelf member extended.

FIGS. 10 and 11 illustrate the position of the bearings 201-204. The bearing 201 is attached to the guide rail 124 at a midpoint 602 of the shelf 110 by any suitable means such as a nut and bolt. The bearing 202 is attached to the guide rail 124 at the right back corner 604 of the shelf 110 by any suitable means such as a nut and bolt. The bearing 203 is attached to the guide rail 125 at a midpoint 603 of the shelf 110 by any suitable means such as a nut and bolt. The bearing 204 is attached to the guide rail 125 at the left back corner 605 of the shelf 110 by any suitable means such as a nut and bolt. The rolling surface of the bearings 201-204 are oriented so that they face outward from the shelf 110 and towards the shelf support tray 111.

FIG. 2, 8, 9, 10, 11 illustrate the shelf support tray 111. The shelf support tray 111 is comprised of guide rails 150-151, stops 152-159, rubber sleeves 160-167, support beams 168-170, and a back plate 171. In the preferred embodiment of the invention, the guide rails 150 and 151 are of I-beam construction. The guide rail 150 has a front end 172 and a back end 174. The guide rail 151 has a front end 173 and a back end 175. The guide rail 150 has a frame side channel 180 and a shelf side channel 181. The guide rail 151 has a frame side channel 182 and shelf side 183.

The shelf support tray 111 is constructed by orienting support beams 168-170 parallel to each other. The guide rails 150-151 are then laid perpendicular and on top of the support beams 168-170. The guide rails 150-151 are positioned at the ends of support beams 168-170 and then attached by any suitable means such as welding. The back plate 171 is then attached to the back ends 174 and 175 of the guide rails 150-151 by any suitable means such as welding.

FIGS. 2, 7, 9, 10 and 11 illustrate the base support 100. The base support 100 is comprised of the shelf support rails 51 and 52, the bearings 251-254, and the rear driver support plate 60. FIGS. 10 and 11 illustrate the placement of bearings 251-254. The bearing 251 is attached to the shelf support rail 51 behind the vertical support 30 using any suitable means such as a nut and bolt. The bearing 252 is attached to the shelf support rail 51 behind the vertical support 31 using any suitable means such as a nut and bolt. The bearing 253 is attached to the shelf support rail 52 behind the vertical support 33 by any suitable means such as a nut and bolt. The bearing 254 is attached to the shelf support rail 52 behind the vertical support 34 by any suitable means such as a nut and bolt.

The shelf member 15 is assembled as follows. The shelf support rail 51 is placed into a desired location within the frame 10 and attached to the vertical adjustment pillars 41-43 by any suitable means such as a nut and bolt. The shelf support rail 52 is placed into a position opposite shelf support rail 52 within the frame 10, and attached to the vertical adjustment pillars 44-46 by any suitable means such as a nut and bolt. The rear driver support plate 60 is placed into the proper position relative to the shelf support rails 51 and 52 and attached to vertical adjustment pillars 43 and 46 by any suitable means such as a nut and bolt.

The shelf 110 is oriented so that the bearings 201 and 202 slide into the shelf side channel 181 of the guide rail 150. The bearings 203 and 204 of the shelf 110 slide into the shelf side channel 183 of the guide rail 151. The shelf side channel 181 and 183 allow the bearings 201-204 to roll freely within the shelf support tray 111. The guide rail 150 lines up with bearings 251 and 252 of the shelf support rail 51, and the guide rail 151 lines up with the bearings 253 and 254 of the shelf support rail 52. The bearings 251 and 252 slide into the frame side channel 180 of the guide rail 150. The bearings 253 and 254 slide into the frame side channel 182 of the guide rail 151. The frame side channel 180 and 182 allow the bearings 251-254 to roll freely within the shelf support tray 111. The shelf member 15 is then rolled into place so that the shelf member 15 fits within the frame 10. The stops 152-159 and the rubber sleeves 160-167 are then attached to the front and back ends 172-175 of the guide rails the of 150 and 151. It should be noted that rubber sleeves 160-167 prevent damage from occurring to the bearings 201-204 and the bearings 251-254 when they come into contact with the stops 152-159. The driver 200 is then attached to the rear driver support plate 60 by any suitable means such as nuts and bolts.

The shelf member 15 extends and retracts in the following manner. As air is fed into the rear of the driver 200 from the drive system 25, the shelf member 15 begins to extend. In particular, the shelf 110 begins to roll forward. The shelf 110 continues to roll forward until the bearings 201 and 203 come into contact with the stops 152 and 154 and the rubber sleeves 160 and 162. The progress of shelf 110 is halted and the shelf support tray 111 begins to move forward. The shelf support tray 111 moves forward until the stops 157 and 159 come into contact with the bearings 252 and 254 thereby halting the progress of the shelf support tray 111.

The shelf member 15 retracts as follows. As air from the drive system 25 is fed to the front of the driver 200, the shelf 110 begins to retract. The shelf 110 continues to roll backward until the bearings 202 and 204 make contact with the stops 156 and 159 and with the rubber sleeves 165 and 167. After contact the progress of the shelf 110 is halted and the shelf support tray 111 begins to roll backward. The shelf support tray 111 continues to roll backward until the bearings 251 and 253 make contact with stops 153 and 155 and rubber sleeves 161 and 163, thereby halting the progress of the shelf support tray 111 and shelf member 15.

The construction of shelf member 15 allows the shelf 110 to substantially, completely extend. FIG. 11 illustrates how this is accomplished. The shelf member 15 includes the shelf 110 and the shelf support tray 111. When the shelf 110 is fully extended, part of the shelf 110 is still contained within the frame 10. However, as the shelf support tray 111 extends, it permits the shelf 110 to fully extend past the frame 10, thus allowing full access to the shelf 110. When the shelf support tray 111 is fully extended, part of the shelf support tray 111 is still contained within the frame 10, which provides the necessary support so that the shelf 110 can fully extend, yet still be supported within the frame 10.

In the preferred embodiment of the invention, the adjustment holes within the vertical adjustment pillars 41-46 permit the positions of the shelf members 15 and 16 to adjust vertically within the frame 10. The shelf members 15 and 16 adjust identically; consequently only shelf member 15 will be described herein. The adjustment of the shelf member 15 is accomplished by removing the attachments from the shelf support rails 51 and 52 of the base support 100. The attachments from the rear driver support plate 60 are also removed. The shelf member 15 is then raised or lowered to the desired position and the shelf support rails 51 and 52 of the base support 100 are reattached to the vertical adjustment pillars 41-46. The rear driver support plate 60 is reattached to the vertical adjustment pillars 43 and 46 in the appropriate position relative to the shelf support rails 51 and 52. It should be noted that the placement of the driver 200 is also important. In other storage systems, drivers are attached to the frame. However, in the preferred embodiment of the invention, the driver 200 attaches to the shelf 110 at the front driver support plate 112 and at the rear driver support plate 60. This placement of the driver 200 permits full extension and retraction of the shelf 110 while also allowing the shelf member 15 to be vertically adjustable within the frame 10.

FIGS. 3, 4, 5, 6 and 12 illustrate the components comprising the drive system 25 of the storage rack system 5. It should be noted that, in the preferred embodiment of the invention, the drive system 25 is a pneumatic drive system; however, those of ordinary skill in the art will recognize many suitable alternative drive systems such as a hydraulic drive system, an electric drive system, or the like. The drive system 25 includes start systems 300 and 301, a manifold 303, a regulator/air filter 304, air valve switches 305 and 306, air valves 307 and 308, limit switches 309 and 310, air lines 350-373, and contact points 700 and 701.

The start systems 300 and 301 are the user interface for the storage rack system 5, and, in the preferred embodiment of the invention, they are push button valves 315-318. The start system 300 controls the shelf member 15 and the start system 301 controls the shelf member 16. The start systems 300 and 301 have two buttons each. The start system 300 has a button labeled "out" which controls the push button valve 315 and a button labeled "in" which controls the push button valve 316. The start system 301 has a button labeled "out" which controls the push button valve 317 and a button labeled "in" which controls the push button valve 318.

Figure 6:
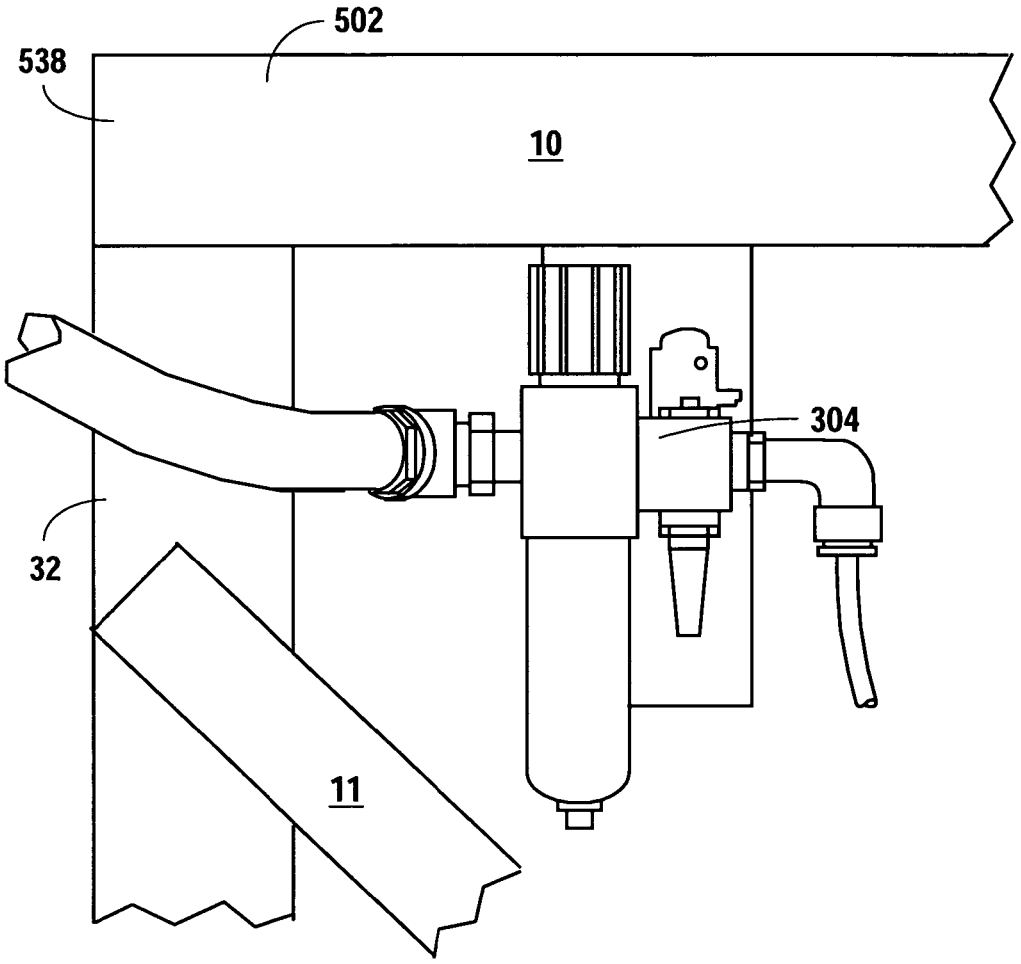
FIG. 6 is a top view illustrating a regulator/air filter of the roll-out shelving storage rack system.
Figure 7:
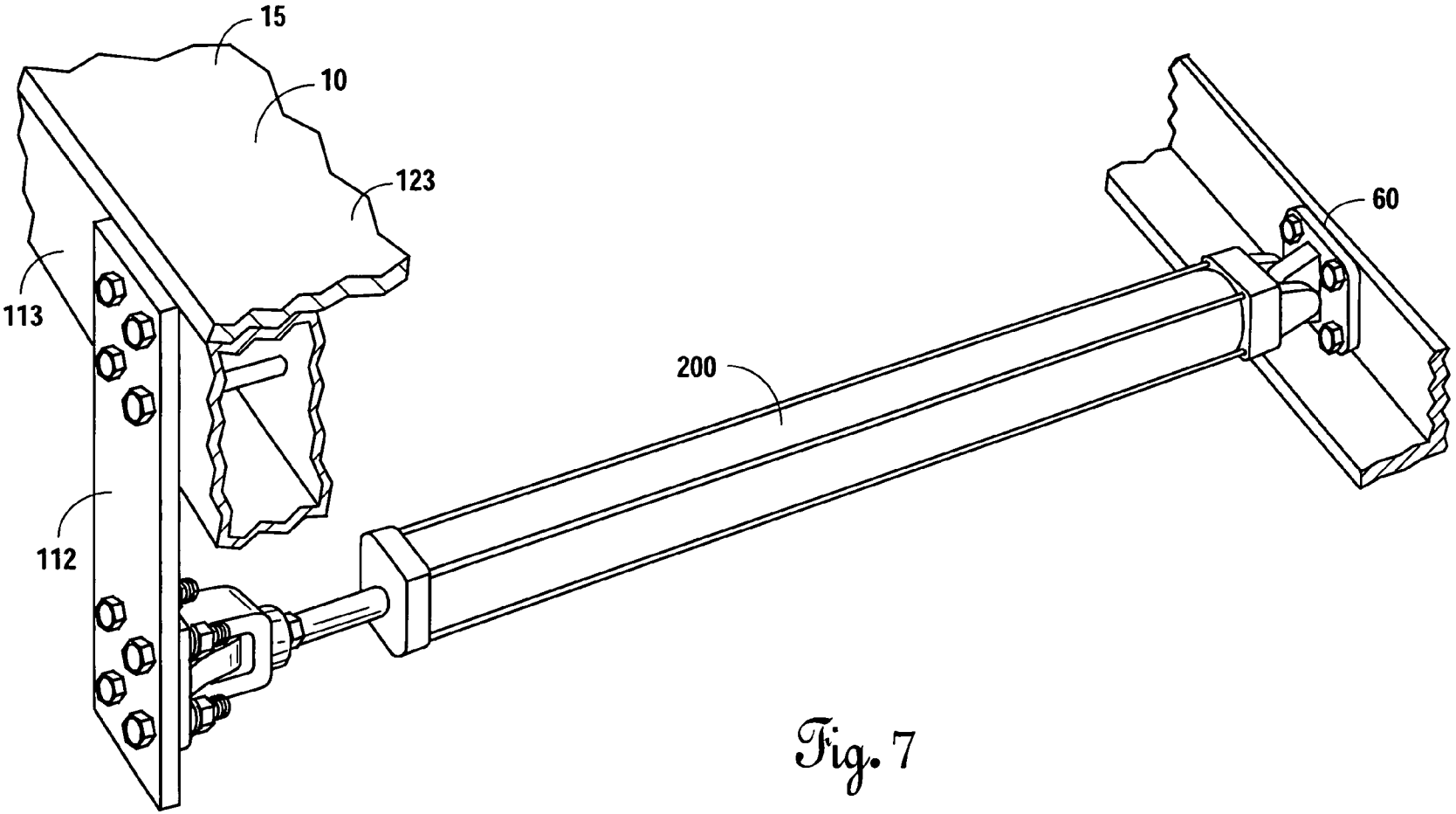
FIG. 7 is a perspective view illustrating a pneumatic cylinder, a front driver support plate, and a rear pneumatic support plate of the roll-out shelving storage rack system.
Figure 8:
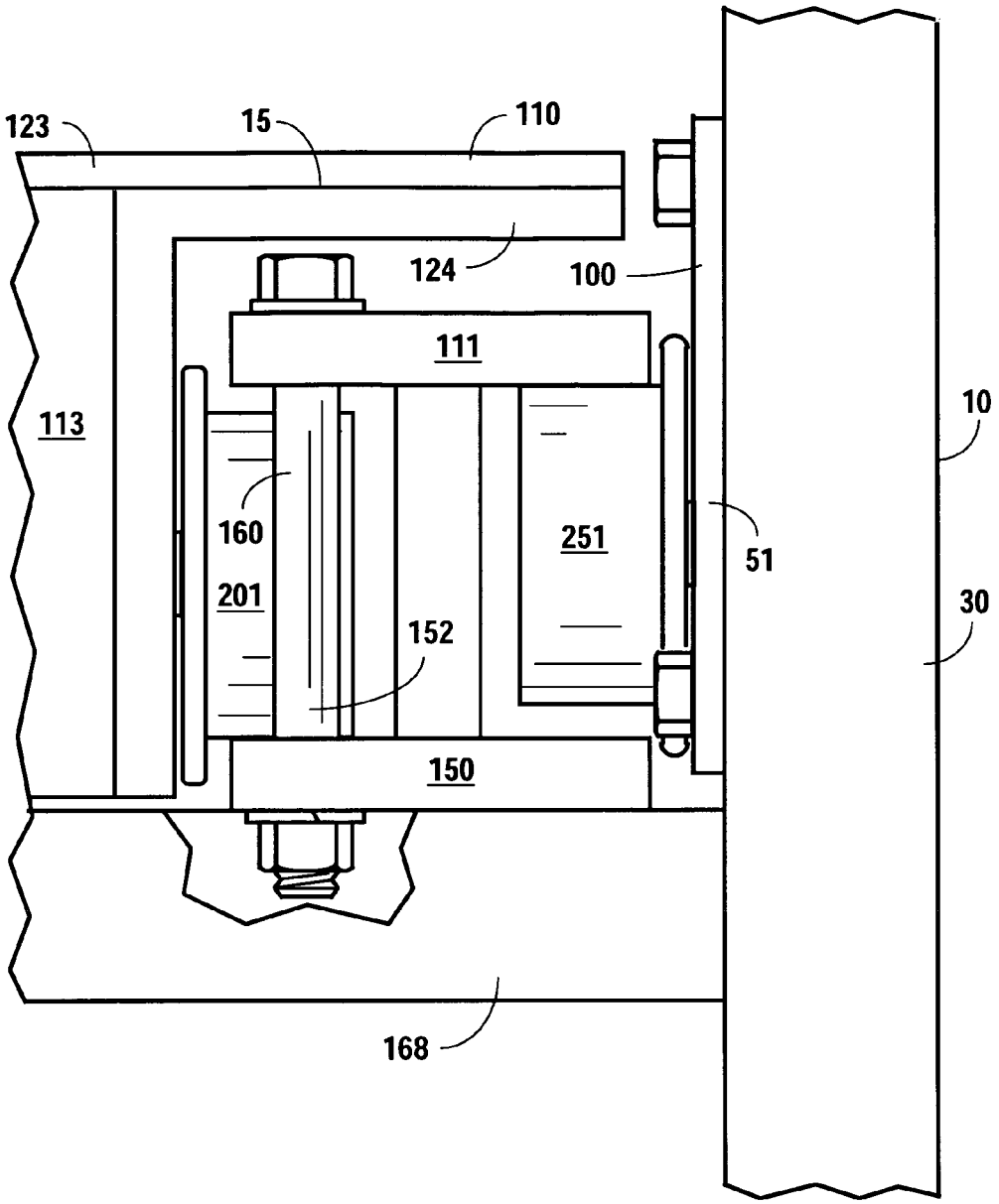
FIG. 8 is a front view partially illustrating a shelf member of the roll-out shelving storage rack system.
Figure 9:
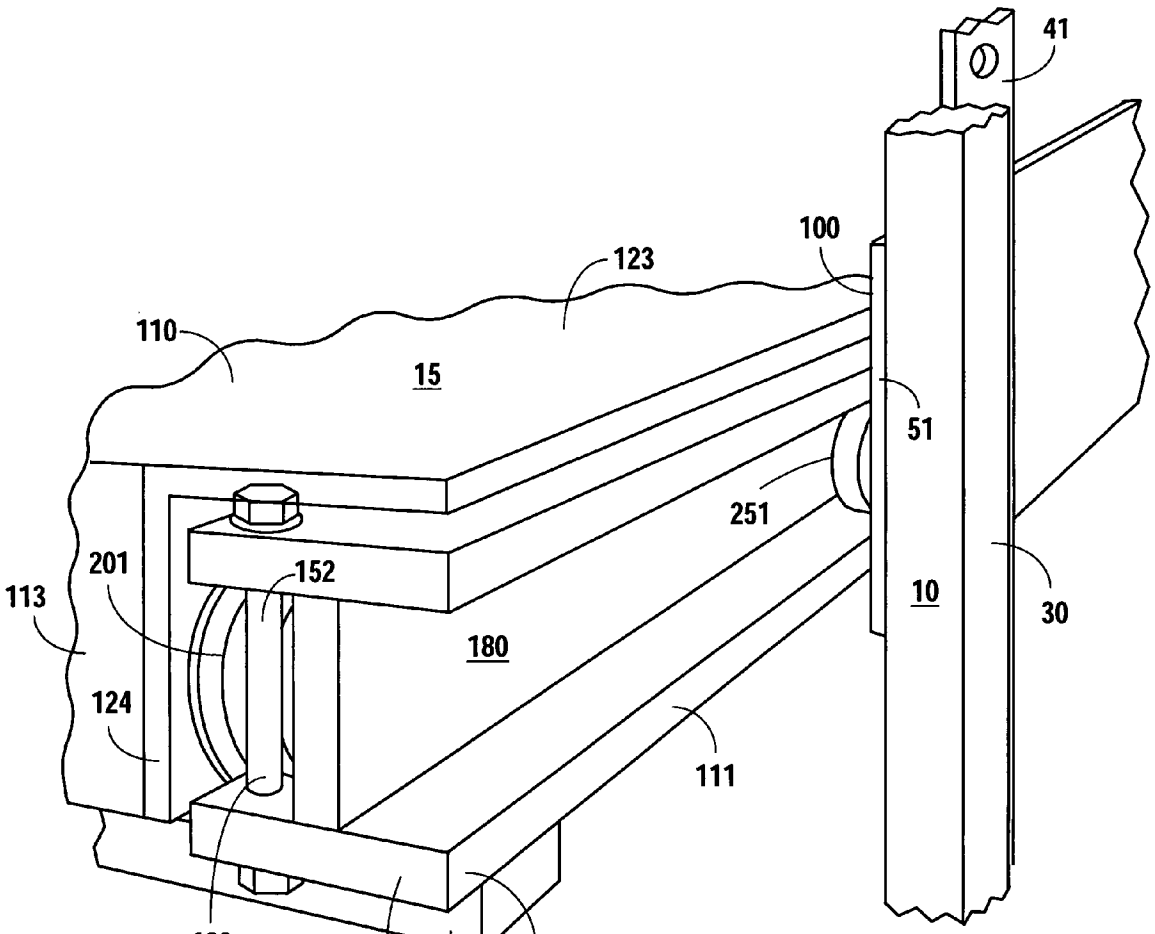
FIG. 9 is a perspective view partially illustrating the shelf member of the roll-out shelving storage rack system.

FIG. 6 illustrates the regulator/air filter 304. The regulator/air filter 304 is the component where outside air enters the drive system 25 using any suitable means such as a compressor or air bottle. The regulator/air filter 304 regulates air pressure and filters the air within the drive system 25. The regulator/air filter 304 also has a lockout system so that air cannot be sent to the drive system 25. This can be useful if the operator wants to prevent unauthorized use of the storage rack system 5. In the preferred embodiment of the invention, the regulator/air filter 304 can be locked using a pad lock. Locking the regulator/air filter 304 prevents air from entering the drive system 25 thereby preventing the shelf members 15 and 16 from extending.

The manifold 303 which receives air from the regulator/air filter 304 distributes air evenly throughout the drive system 25. The manifold 303 distributes air to the start systems 300 and 301, the air valves switches 305 and 306, the air valves 307 and 308, and the limit switches 309 and 310.

Figure 12:
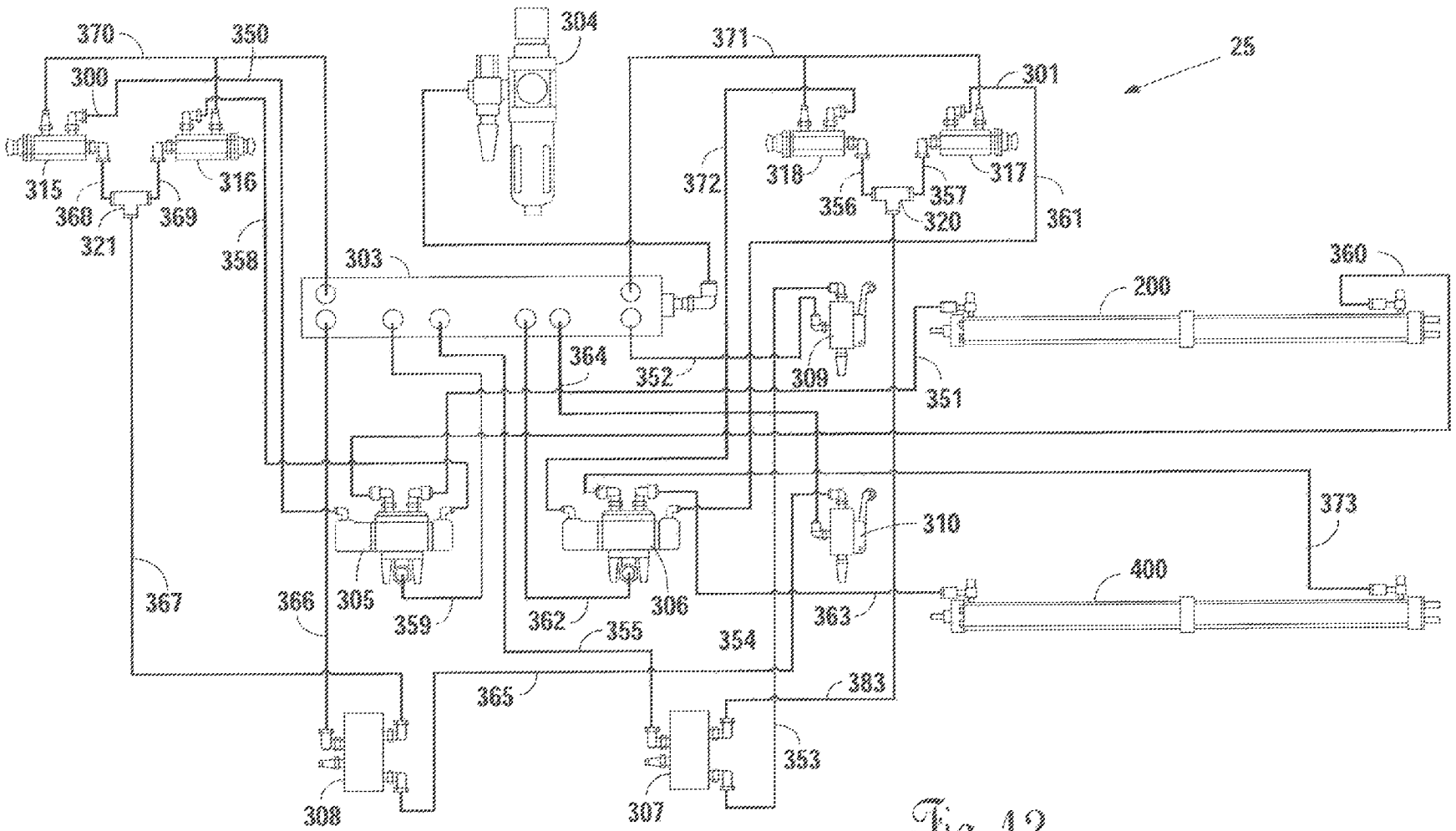
FIG. 12 is a schematic illustrating a drive system of the roll-out shelving storage rack system.

FIG. 12 illustrates the air valve switches 305 and 306. The air valve switch 305 switches air between the front and the back of the driver 200, while the air valve switch 306 switches air between the front and the back of a driver 400 for the shelf member 16. This allows the driver 200 or the driver 400 to either extend or retract.

Figure 4:
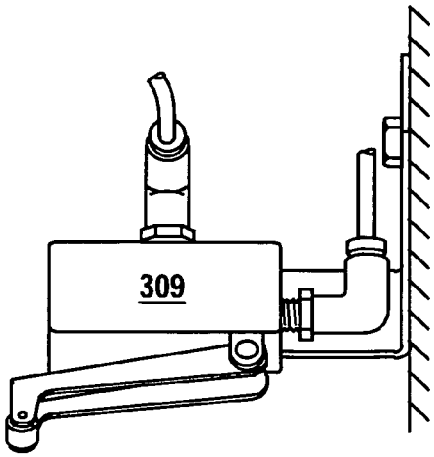
FIG. 4 is a top view illustrating the limit switch of the roll-out shelving storage rack system.
Figure 5:
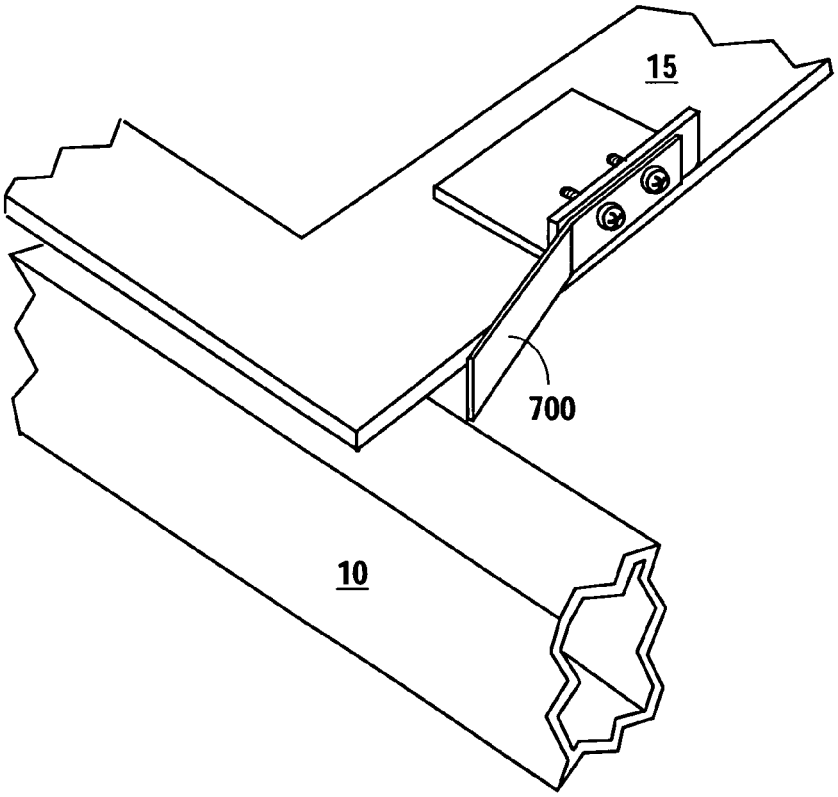
FIG. 5 is a perspective view illustrating a shelf member and the contact point of the roll-out shelving storage rack system.

FIGS. 4 and 12 illustrate the limit switches 309 and 310. The limit switches 309 and 310 are a safety mechanism for the drive system 25. Problems could arise if the shelf members 15 and 16 extended at the same time or if one shelf member 15 or 16 extends when the other is already extended. In particular, the storage rack system 5 may tip over or an operator might be struck by one of the shelf members 15 or 16. When engaged the limit switches 309 and 310 prevent either shelf member 15 and 16 from operating. The operation of limit switches 309 and 310 will be explained in greater detail below.

The operation of the drive system 25 is as follows. An operator presses and holds down the "out" button on the start system 300. This allows air that flows into the push button valve 315 from the air line 370 to pass into the air line 350. The air travels through the air line 350 and into a first side of the valve switch 305. The air from the push button valve 315 shifts a piston inside the valve switch 305 away from the first side of the valve switch 305 such that air flows from the regulator/air filter 304 into the valve switch 305 via the air line 359. When the piston shifts away from the first side of the valve switch 305, the valve switch 305 routes air into the air line 351, which, in turn, delivers the air into the back of the driver 200. This air entering the back of the driver 200 results in the extension of the driver 200.

As the driver 200 extends, the shelf member 15 extends such that the contact point 700 breaks contact with the limit switch 309. The regulator/air filter 304 feeds air to the limit switch 309 through the air line 352. However, as long as the limit switch 309 keeps in contact with the shelf member 15, air does not pass through limit switch 309. Conversely, when the contact point 700 on the shelf member 15 separates from the limit switch 309, air passes through the limit switch 309 and into the air line 353. The air travels through the air line 353 and into the air valve 307, which shifts a piston inside the air valve 307. When the piston shifts, air flows from the regulator/air filter 304 through the air valve 307 via the air line 355. Air exiting the air valve switch 307 travels through the air line 383 and enters the splitter 320. The splitter 320 sends air through the air lines 356 and 357. The air from the airlines 356 and 357 travels into the push button valves 317 and 318 of the start system 301. A piston inside each of the push button valves 317 and 318 locks thereby preventing operation of the push button valves 317 and 318 and thus the operation of the shelf member 16.

To retract the shelf member 15, an operator presses and holds down the "in" button on the start system 300. This allows air that flows into the push button valve 316 from the air line 370 to pass into the air line 358. The air travels through the air line 358 and into the air valve switch 305. The air travels through the air line 358 and into a second side of the valve switch 305. The air from the push button valve 316 shifts a piston inside the valve switch 305 away from the second side of the valve switch 305 such that air flows from the regulator/air filter 304 into the valve switch 305 via the air line 359. When the piston shifts away from the second side of the valve switch 305, the valve switch 305 routes air into the air line 360, which, in turn, delivers the air into the front of the driver 200. This air entering the front of the driver 200 results in the retraction of the driver 200.

As the driver 200 retracts, the shelf member 15 retracts such that the contact point 700 comes into contact with the limit switch 309. This contact closes the limit switch 309 and cuts off air flow through the air line 353 to the air valve 307. With its air flow cut off, the air valve 307 closes which stops air flow to the push button valves 317 and 318 via the air line 383 and the splitter 320. This releases the lock out of the push button valves 317 and 318 resulting in the shelf member 16 again becoming operational.

Shelf member 16 extends and retracts in the same matter. An operator presses and holds down the "out" button on the start system 301. This allows air that flows into the push button valve 317 from the air line 371 to pass into the air line 361. The air travels through the air line 361 and into the valve switch 306. The air from the push button valve 317 shifts a piston inside the valve switch 306 away from the first side of the valve switch 306 such that air flows from the regulator/air filter 304 into the valve switch 306 via the air line 362. When the piston shifts away from the first side of the valve switch 306, the valve switch 306 routes air into the air line 363, which, in turn, delivers the air into the back of the driver 400. This air entering the back of the driver 400 results in the extension of the driver 400.

As the driver 400 extends, the shelf member 16 extends such that the contact point 701 breaks contact with the limit switch 310. The regulator/air filter 304 feeds air to the limit switch 310 through the air line 364. However, as long as the limit switch 310 keeps in contact with the shelf member 16, air does not pass through limit switch 310. Conversely, when the contact point 701 of the shelf member 16 separates from the limit switch 310, air passes through the limit switch 310 and into the air line 365. The air travels through the air line 365 and into the air valve 308, which shifts a piston inside the air valve 308. When the piston shifts, air flows from the regulator/air filter 304 through the air valve 308 via the air line 366. Air exiting the air valve switch 308 travels through the air line 367 and enters the splitter 321. The splitter 321 sends air through the air lines 368 and 369. The air from the airlines 368 and 369 travels into the push button valves 315 and 316 of the start system 300. A piston inside each of the push button valves 315 and 316 locks thereby preventing operation of the push button valves 315 and 316 and thus the operation of the shelf member 15.

To retract the shelf member 16, an operator presses and holds down the "in" button on the start system 301. This allows air that flows into the push button valve 318 from the air line 371 to pass into the air line 372. The air travels through the air line 372 and into the air valve switch 306. The air travels through the air line 372 and into a second side of the valve switch 306. The air from the push button valve 318 shifts a piston inside the valve switch 306 away from the second side of the valve switch 306 such that air flows from the regulator/air filter 304 into the valve switch 305 via the air line 362. When the piston shifts away from the second side of the valve switch 306, the valve switch 306 routes air into the air line 373, which, in turn, delivers the air into the front of the driver 400. This air entering the front of the driver 400 results in the retraction of the driver 400.

The air causes the driver 400 to retract which, in turn, causes the shelf member 16 to retract. As the shelf member 16 retracts, the contact point 701 comes in contact with the limit switch 310, thereby closing the limit switch 310 and cutting off air flow through the air line 365 to the air valve 308. With its air flow cut off, the air valve 308 closes which stops air flow to the push button valves 315 and 316 via the air line 367 and the splitter 321. This releases the lock out of the push button valves 315 and 316 resulting in the shelf member 15 again becoming operational.

While the preferred embodiment of the invention discloses the drive system 25 controlling two shelf members 15 and 16, those of ordinary skill in the art will recognize that the drive system 25 may be adapted to control a single shelf member or three or more shelf members. By way of example, a single shelf member configuration would require include one start system and one valve switch. Conversely, a three or more shelf configuration would include start systems, valve switches, limit switches, and air valves corresponding to the number of shelf members.

Although the present invention has been described in terms of the foregoing embodiment, such description has been for exemplary purposes only and, as will be apparent to those of ordinary skill in the art, many alternatives, equivalents, and variations of varying degrees will fall within the scope of the present invention. That scope, accordingly, is not to be limited in any respect by the foregoing description; rather, it is defined only by the claims that follow.

The invention claimed is:

1. A roll-out shelving storage rack system, comprising:

a frame;

a first shelf member, the shelf member comprising:

a base support mounted to the frame, a shelf support tray engaged with the base support and movable between a retracted position and an extended position, a shelf engaged with the shelf support tray and movable between a retracted position and an extended position, and a first driver coupled with the base support and the shelf, wherein actuation of the first driver moves the shelf from its retracted position to its extended position, further wherein, when the shelf reaches its extended position, the shelf support tray moves from its refracted position to its extended position, thereby extending the shelf substantially, completely exterior to the frame;

a second shelf member, the second shelf member comprising:

a base support mounted to the frame, a shelf support tray engaged with the base support and movable between a retracted position and an extended position, a shelf engaged with the shelf support tray and movable between a retracted position and an extended position, and a second driver coupled with the base support and the shelf, wherein actuation of the second driver moves the shelf from its retracted position to its extended position, further wherein, when the shelf reaches its extended position, the shelf support tray moves from its retracted position to its extended position, thereby extending the shelf substantially, completely exterior to the frame; and a drive system coupled with the first driver and the second driver for moving the first shelf member and the second shelf member between extended and retracted positions, wherein the drive system disables the second driver during extension and retraction of the first shelf member, further wherein the drive system disables the first driver during extension and retraction of the second shelf member, the drive system, comprising:

a manifold coupled with a source of pressurized air for distributing pressurized air throughout the drive system, a first start system for the first shelf member, the first start system comprising an "out" push button valve and an "in" push button valve, and a first air valve switch coupled with the first start system, wherein activation of the "out" push button valve of the first start system actuates the first air valve switch such that the first air valve switch operates the first driver of the first shelf member to extend the first shelf member, further wherein activation of the "in" push button of the first start system actuates the first air valve switch such that the first air valve switch operates the first driver of the first shelf member to retract the first shelf member.

2. The roll-out shelving storage rack system according to claim 1, wherein the drive system comprises:

a second start system for the second shelf member, the second start system comprising an "out" push button valve and an "in" push button valve; and a second air valve switch coupled with the second start system, wherein activation of the "out" push button valve of the second start system actuates the second air valve switch such that the second air valve switch operates the second driver of the second shelf member to extend the second shelf member, further wherein activation of the "in" push button valve of the second start system actuates the second air valve switch such that the second air valve switch operates the second driver of the second shelf member to retract the second shelf member.

3. The roll-out shelving storage rack system according to claim 2, wherein the drive system further comprises:

a first limit switch engageable by the first shelf member, wherein the first limit switch closes when the first shelf member resides in its refracted position, further wherein the first limit switch opens when the first shelf member moves from its retracted position;

a first air valve coupled with the first limit switch, wherein, when the first limit switch opens, the first air valve prevents activation of the "out" and "in" push button valves of the second start system.

4. The roll-out shelving storage rack system according to claim 3, wherein the drive system further comprises:

a second limit switch engageable by the second shelf member, wherein the second limit switch closes when the second shelf member resides in its retracted position, further wherein the second limit switch opens when the second shelf member moves from its retracted position;

a second air valve coupled with the second limit switch, wherein, when the second limit switch opens, the second air valve prevents activation of the "out" and "in" push button valves of the first start system.

5. The roll-out shelving storage rack system according to claim 1, wherein the frame comprises a top member with a greater weight carrying capacity than the first and second shelf members.

6. The roll-out shelving storage rack system according to claim 1, wherein the frame comprises vertical adjustment pillars that permit vertical adjustment of the first and second shelf members within the frame.

7. The roll-out shelving storage rack system according to claim 1, wherein:

the coupling of the first driver between the base support and the shelf of the first shelf member permits the vertical adjustment of the first shelf member within the frame; and the coupling of the second driver between the base support and the shelf of the second shelf member permits the vertical adjustment of the second shelf member within the frame.

8. The roll-out shelving storage rack system according to claim 1, wherein the base supports of the first and second shelf members each comprise:

a first shelf support rail securable to the frame;

a second shelf support rail securable to the frame;

a rear driver support plate secured with the first and second shelf support rails;

first and second bearings connected to the first shelf support rail; and third and fourth bearings connected to the second shelf support rail.

9. The roll-out shelving storage rack system according to claim 8, wherein the shelf support trays of the first and second shelf members each comprise:

a back plate;

first and second guiderails connected to the back plate, each of the first and second guiderails comprising an I-beam defining a frame side channel and a shelf side channel, wherein the frame side channel of the first guiderail receives therein the first and second bearings of the base support and the frame side channel of the second guiderail receives therein the third and fourth bearings of the base support, further wherein the positioning of the first and second bearings substantially, completely within the frame side channel of the first guiderail and the third and fourth bearings substantially, completely within the frame side channel of the second guiderail connects the shelf support tray with the base support such that the shelf support tray is movable within the base support between its retracted position and its extended position; and a plurality of support beams connected to the first and second guiderails and to the back plate.

10. The roll-out shelving storage rack system according to claim 9, wherein the shelves of the first and second shelf members each comprise:

a support grid;

a front support bar connected to the support grid;

a rear support bar connected to the support grid;

first and second guiderails connected to the front support bar, the rear support bar, and the support grid;

a surface plate connected to the front support bar, the rear support bar, the support grid, and the first and second guiderails;

first and second bearings connected to the first guiderail; and third and fourth bearings connected to the second guiderail, wherein the shelf side channel of the first guiderail of the shelf support tray receives therein the first and second bearings of the shelf and the shelf side channel of the second guiderail of the shelf support tray receives therein the third and fourth bearings of the shelf, further wherein the positioning of the first and second bearings substantially, completely within the shelf side channel of the first guiderail and the third and fourth bearings substantially, completely within the shelf side channel of the second guiderail connects the shelf with the shelf support tray such that the shelf is movable within the shelf support tray between its retracted position and its extended position.

11. The roll-out shelving storage rack system according to claim 8, wherein the first and second shelf support rails of the base support each removably engage the vertical adjustment pillars of the frame to permit the vertical adjustment of the first shelf member within the frame.

12. The roll-out shelving storage rack system according to claim 10, wherein the first and second guiderails of each shelf support tray include stops that halt progress of each shelf within each shelf support tray and each shelf support tray within each base support.

13. The roll-out shelving storage rack system according to claim 10, wherein each of the first and second drivers attaches respectively to the front support bar of the first and second shelves and the rear driver support plate of each base support, thereby allowing the first and the second shelf members to be vertically adjustable within in the frame.

* * * * *